US006925737B2

(12) United States Patent
Bolduan et al.

(10) Patent No.: US 6,925,737 B2
(45) Date of Patent: Aug. 9, 2005

(54) METHOD AND APPARATUS FOR SMOOTHING ITEMS OF CLOTHING

(75) Inventors: Edwin Bolduan, Berlin (DE); Wolfgang Proppe, Berlin (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 48 days.

(21) Appl. No.: 10/609,461

(22) Filed: Jun. 27, 2003

(65) Prior Publication Data

US 2004/0055186 A1 Mar. 25, 2004

Related U.S. Application Data

(63) Continuation of application No. PCT/EP01/14864, filed on Oct. 17, 2001.

(30) Foreign Application Priority Data

Dec. 27, 2000 (DE) ..... 100 65 335
Dec. 27, 2000 (DE) ..... 100 65 334
Dec. 27, 2000 (DE) ..... 100 65 336

(51) Int. Cl.[7] ..... D06F 58/10
(52) U.S. Cl. ..... 38/1 A; 38/14
(58) Field of Search ..... 38/1 A, 14, 7, 38/1 R, 16; 392/386, 387; 68/222

(56) References Cited

U.S. PATENT DOCUMENTS 4,682,424 A * 7/1987 Irving ..... 34/621
5,094,020 A * 3/1992 Wingfield et al. ..... 38/1 A
5,815,961 A * 10/1998 Estes et al. ..... 38/14

FOREIGN PATENT DOCUMENTS

| | | | |
|---|---|---|---|
| DE | 31 19 560 A1 | | 12/1982 |
| DE | 36 27 940 A1 | | 3/1988 |
| DE | 197 12 848 A1 | | 10/1998 |
| EP | 079866 | * | 9/1982 |
| EP | 573726 | * | 10/1992 |
| FR | 2 721 625 A1 | | 12/1995 |

* cited by examiner

*Primary Examiner*—Ismael Izaguirre
(74) *Attorney, Agent, or Firm*—John T. Winburn; Russell W. Warnock; Craig J. Loest

(57) ABSTRACT

To improve a smoothing effect on items of clothing by subjecting the items to moisture and heat and, thereby, relaxing the fabric of the clothing items to reduce creases, an apparatus and a method of smoothing includes subjecting the items of clothing, preferably, in a heated and moistened state, to at least one gas jet, in particular, a compressed air jet, which is not aligned parallel to the clothing item and which exerts a force on the clothing item. Advantageously, the clothing item is subjected to gas jets from both sides.

25 Claims, 2 Drawing Sheets

METHOD AND APPARATUS FOR SMOOTHING ITEMS OF CLOTHING

CROSS-REFERENCE TO RELATED APPLICATION

This application is a continuation of copending International Application No. PCT/EP01/14864, filed Oct. 17, 2001, which designated the United States and was not published in English.

BACKGROUND OF THE INVENTION

1. Field of the Invention

The invention relates to a method and an apparatus for smoothing items of clothing.

Numerous methods and apparatuses for smoothing items of clothing exist. For example, it is known to press the fabric of the item of clothing to be smoothed by pressure with a flat object. The prior art irons or ironing presses may be used for such a purpose. In addition, for smoothing sensitive items of clothing, in particular, it is known to subject them to heat and steam, whereby the fibers of an item of clothing are made to relax and, as such, the creases can be eliminated. An apparatus for applying this method is known, for example, from German Published, Non-Prosecuted Patent Application DE 3119560. However, this smoothing method disadvantageously has only a very slight smoothing effect because the fibers of the item of clothing are only made to relax and are not necessarily smoothed. In addition, the fibers of an item of clothing may become so permanently creased over time that the crease is impressed in the fiber structure such that, without being subjected to external mechanical action, the fiber in the relaxed state tends to assume the creased state. In such a case, without mechanical action, a smoothing method can achieve a smoothing effect only with the aid of steam and heat.

2. Summary of the Invention

It is accordingly an object of the invention to provide a method and apparatus for smoothing items of clothing that overcome the hereinafore-mentioned disadvantages of the heretofore-known devices and methods of this general type and that achieves an improved smoothing effect while gently treating the item of clothing to be smoothed.

With the foregoing and other objects in view, there is provided, in accordance with the invention, a method for smoothing items of clothing, including the steps of providing an item of clothing, providing at least one gas jet for supplying a stream of a gas, and subjecting the clothing item at least in one portion to the at least one gas jet in a direction not parallel to the one portion.

The use of a gas jet, which is, preferably, an air jet and exerts a force on the item of clothing to be smoothed, allows a smoothing effect to be achieved with little effort, at the same time treating the item of clothing very gently. The gas jet allows the fabric of the item of clothing to be pressed into in specific places or a tensile force to be exerted on the entire item of clothing, whereby it is stretched. As such, any creases that may exist are smoothed. The smoothing effect of the gas jet can be increased by making the fabric of the item of clothing relax before the smoothing operation or at the beginning of a smoothing operation by moistening and heating the fabric of the item of clothing. For such a purpose, water vapor can be mixed in with the gas jet and directed in this way onto the fabric. Furthermore, it is possible to sprinkle the item of clothing with water, it being possible for the water to be sprinkled by the nozzle with which the gas jet is directed onto the item of clothing, or by a nozzle of its own, which is not used for generating the gas jet.

The at least one gas jet necessarily has the effect that a force is exerted on the item of clothing. As a result, the item of clothing can be moved in a disadvantageous way, and, possibly, crumpled thereby. This can be prevented, for example, by using a gas jet having a high outflow velocity but a small diameter. Such a configuration has the overall effect of not exerting a great force on the item of clothing by the gas jet, and the clothing is, therefore, influenced little in its position. Nonetheless, a high stretching effect on the fabric can be achieved in a small area on the item of clothing, and, consequently, a high smoothing effect. In this respect it may be provided that, in the case of suspended items of clothing, the deflection caused by the gas jet is compensated at least partly by the suspension of the item of clothing being drawn slightly toward the nozzle from which the gas jet is flowing.

In accordance with another mode of the invention, the clothing item is supported from a side of the clothing item opposite the gas jet.

The item of clothing is, advantageously, supported while it is subjected to the gas jet. The item of clothing can, consequently, be prevented from being moved by the force of the gas jet. Furthermore, this allows a stronger gas jet to be used and, consequently, a better smoothing effect to be achieved. The support may take place by fixed supports, such as, for example, at least one supporting surface. If the item of clothing is moved, for example, by running through a number of treatment stations, such supports may also be set up such that they can be moved along with the item of clothing. For example, at least one supporting roller mounted rotatably about an axis aligned substantially perpendicularly to the direction of movement of the item of clothing may be used.

In accordance with a further mode of the invention, the item of clothing is supported by a gas jet. In such an embodiment, the item of clothing is subjected to at least one gas jet from both sides. As such, impressions in the fabric that may occur in the case of fixed supports can be avoided. Furthermore, the smoothing effect is intensified because a force from a gas jet is exerted from both sides.

In accordance with an added mode of the invention, the clothing item is supported with an air-permeable supporting surface.

In accordance with an additional mode of the invention, the clothing item is disposed between two air-permeable surfaces.

In accordance with yet another mode of the invention, the gas jet acts on both sides of the item of clothing to exert a total force on the clothing item that is equal in an amount in opposing directions.

In accordance with yet a further mode of the invention, the gas jet exerts a force on both sides of the item of clothing such that a total force on the clothing item is equal in opposing directions.

The gas jets acting from both sides may be coordinated with one another, in particular, such that the portion of the item of clothing situated in between is deformed in a specific manner in order to achieve a good smoothing result. For such a purpose, the force exerted from both sides by the gas jets may be distributed over a specific surface area in each case with a non-uniform force distribution. The force distributions over the surface areas on both sides may be set differently so that, in one portion of the item of clothing, the force exerted on the portion from a first side is greater than the force exerted from the other side and, in a portion lying alongside, the force exerted from the second side predominates. As such, the item of clothing can be deformed in a defined way so that, for example, it assumes a crinkled form, or elevations to one side or the other form in the item of clothing. For example, a gas jet that widens conically and is internally hollow may be used from one side, with the result that it exerts a force in an annular area on the surface of the item of clothing, and a gas jet that generates force exclusively in a small punctiform or circular area is used from the other side, the punctiform or circular area being located within the annular area of the force exerted from the opposite side. Such a configuration has the effect that the fabric of the item of clothing is stretched and smoothed between the annular area and the punctiform or circular area lying in it. Instead of a punctiform or circular surface pressure of the one gas jet, a substantially linear surface pressure may also be chosen. Generally, force effect acting in different directions in adjacent areas allows the fabric to be stretched and smoothed in these areas.

In accordance with yet an added mode of the invention, the forces acting from both sides may be coordinated such that the item of clothing is held in a specific local area and, in particular, the item of clothing is prevented from coming into unwanted contact with other parts, whereby soiling or crumpling can be prevented. Because the force of a gas jet used decreases as it becomes more distant from the nozzle, the configuration, alignment, and outflow characteristics of nozzles lying opposite one another and directed toward one another can create a control system that attempts to keep the items of clothing at a specific location between the nozzles.

In this respect, however, it may also be provided that the location of the item of clothing or of a portion of the item of clothing is sensed and the sensed location is used as an input variable of a control system, which controls the gas jets acting on the item of clothing from different sides such that the item of clothing or the portion of the item of clothing is always located at a predetermined set location or set locational area. The location sensing may be carried out by light barriers or reflection light barriers, it also being possible for other methods of distance measurement or location sensing, for example, by ultrasound, to be used.

The interaction of the forces exerted on the item of clothing from both sides and the force distribution over the surface area allows the fabric of the item of clothing to be stretched in a gentle but, at the same time, forcible way, and, consequently, to achieve a great smoothing effect. In this respect, the force distribution and/or the total force exerted from the individual sides may be varied over time so that a changing deformation is achieved, which may have advantageous effects on the smoothing operation.

In accordance with yet an additional mode of the invention, the at least one gas jet and the clothing item are moved with respect to one another.

In accordance with again another mode of the invention, a heated gas stream is supplied with the at least one gas jet.

In accordance with again a further mode of the invention, water vapor is supplied with the gas stream from the at least one gas jet.

In accordance with again an added mode of the invention, at the end of a smoothing operation of the clothing item, substantially dry and heated air is initially supplied to the clothing item with the at least one gas jet and substantially dry and non-heated air is subsequently supplied to the clothing item with the at least one gas jet.

In accordance with again an additional mode of the invention, the clothing item is initially moistened.

In accordance with still another mode of the invention, the clothing item is moistened before subjecting the clothing item to the at least one gas jet.

In accordance with still a further mode of the invention, at least one of an outflow speed, a volume flow, and a directional distribution of the at least one gas jet is changed when subjecting the clothing item to the gas stream of the at least one gas jet.

With the objects of the invention in view, there is also provided a method for smoothing items of clothing, including the steps of providing an item of clothing, providing at least one gas jet for supplying a stream of a gas, and directing the gas stream towards at least one portion of the clothing item at an angle to the one portion.

With the objects of the invention in view, there is also provided an apparatus for smoothing items of clothing, including a treatment housing defining a treatment space therein, devices disposed in the housing for placing an item of clothing inside the treatment space, a blower for generating a gas flow, and nozzles communicating with the blower for generating a gas stream in the housing, the nozzles being disposed in the housing and being aligned to direct the gas stream generated by the gas flow from the blower at the clothing item.

In accordance with still an added feature of the invention, there is provided a moistening device communicating with at least one of the nozzles for moistening the gas stream.

In accordance with a concomitant feature of the invention, the nozzles are aligned to direct the gas stream at an angle to the clothing item, in other words, the nozzles are aligned to direct the gas stream to at least a portion of the clothing item in a direction not parallel to the portion of the clothing item.

Other features that are considered as characteristic for the invention are set forth in the appended claims.

Although the invention is illustrated and described herein as embodied in a method and apparatus for smoothing items of clothing, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
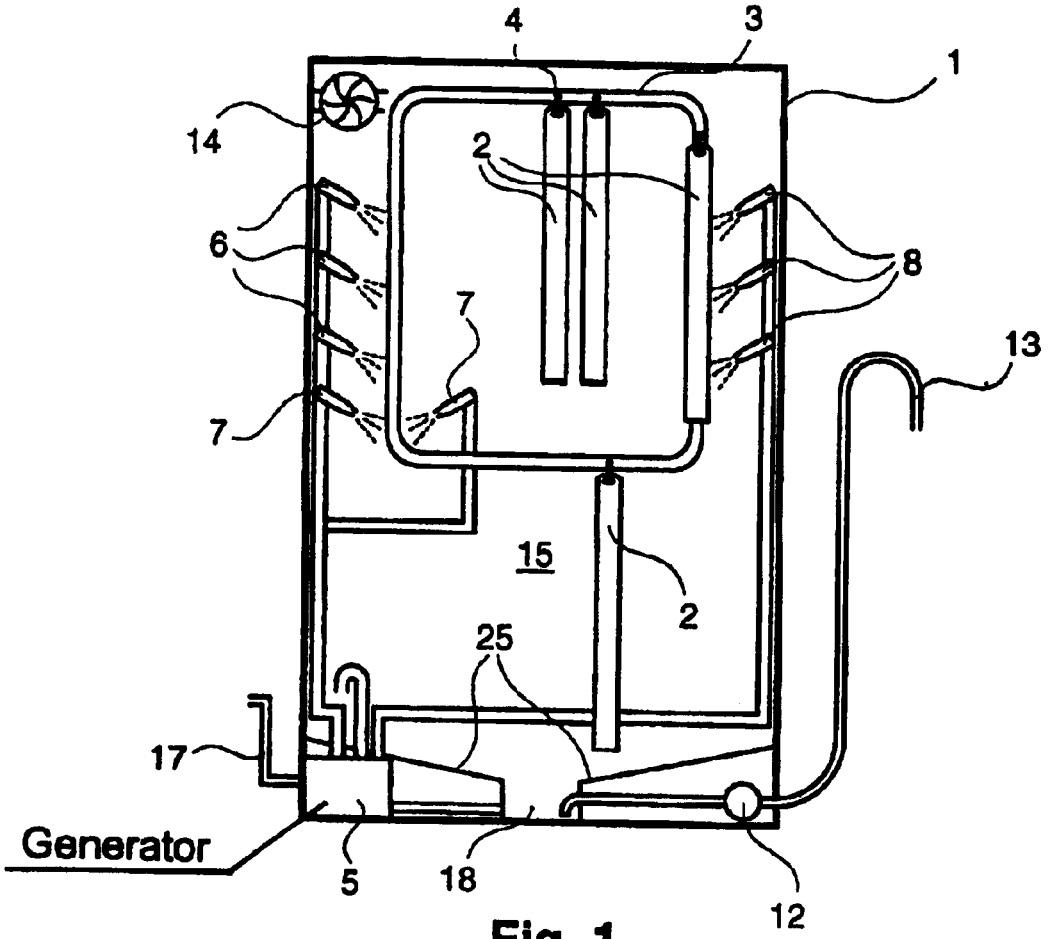
FIG. 1 is a cross-sectional view of a first embodiment of an apparatus according to the invention for smoothing items of clothing.

Referring now to the figures of the drawings in detail and first, particularly to FIG. 1 thereof, there is shown an apparatus for washing and smoothing items of clothing 2 of all kinds, such as items in the form of shirts or pants, has a cuboidal or cabinet-like housing 1, which serves for receiving the items of clothing 2 to be smoothed. Disposed within the housing 1 on two mutually opposite inside walls there is, respectively, a closed transporting belt 3 mounted in a circulating manner, one of the transporting belts 3 being illustrated in plan view in FIG. 1. The two transporting belts 3 may be driven in the same direction and with the same circulating speed in the clockwise sense. Disposed between the transporting belts 3 are non-illustrated connecting struts, fastened to which are suspending devices 4 on which the items of clothing 2 to be smoothed are suspended. The suspending devices 4 have substantially the form of a clothes hanger. As a result, in particular, items of outer clothing of all kinds can be suspended thereon.

The transporting belts 3 are disposed in the upper region of the housing 1 and have the form of a rectangle. As a result, the items of clothing 2 can be moved upward on the left side, to the right at the top, downward on the right side and to the left at the bottom. At the bottom of the left-hand side wall of the housing 1, two oppositely disposed compressed air nozzles 7 are disposed such that the items of clothing can be moved by the transporting belts 3 upward through the intermediate space between the compressed air nozzles 7. Above the compressed air nozzles 7, hot air nozzles 6 are disposed one above the other on the left-hand side wall, the hot air nozzles 6 only being disposed however on the outer side of the path of movement of the items of clothing 2. As a result, the items of clothing can only be acted on by the hot air nozzles from one side. The compressed air nozzles 7 and the hot air nozzles 6 are connected to a generator 5, which has a blower and can generate air jets of different temperatures and with different pressures. The generator 5 has an air inlet inside the housing 1 and an air inlet 17 outside the housing 1, with which fresh air can be drawn in.

Disposed on the right-hand side wall are liquid nozzles 8 for spraying washing liquid and rinsing liquid. The liquid nozzles 8 are, likewise, connected to the generator 5, which furthermore has a pump for delivering liquids. The generator 5 has, for the feeding of liquid, a non-illustrated fresh water feed, which can be connected to a fresh water source or a water connection in a household, and is connected, furthermore, to a sump 18 within the housing 1. The sump 18 is formed in a false floor 25, which is disposed at the bottom within the housing 1 and is shaped such that all the liquid from the upper part of the housing 1 collects at the bottom in the sump 18. The false floor 25 also has the function of dividing off a dry space, in which the generator 5 is accommodated. Also disposed in the dry space is an outflow pump 12, the inlet of which opens into the sump 18 and the outlet 13 of which leads to the outside and can be connected to a wastewater connection, in particular, of a household.

The generator 5 is set up such that the liquid nozzles 8 can be supplied with liquid either that the generator 5 has drawn in from the sump 18 or that originates from the fresh water feed. Furthermore, the generator 5 has a heating device for the liquid pumped to the liquid nozzles 8.

Figure 2:
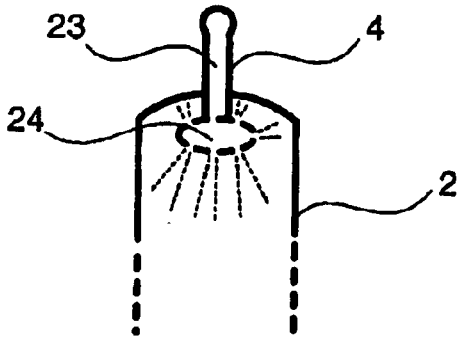
FIG. 2 is a fragmentary, cross-sectional view through an apparatus for disposing items of clothing for use in the smoothing apparatus of FIG. 1.

Represented in section in FIG. 2, by way of example, is a suspending device 4, which has a hollow connecting portion 23 and a hanger portion 24, which is connected to the latter at the bottom, extends perpendicularly to the plane of the drawing, and has a length corresponding substantially to the width of an item of clothing 2. The hanger portion 24 is hollow and has openings distributed around its periphery. The suspending devices 4 are connected to the generator 5 by devices not represented, such that the interior space of the connecting portion 23 and of the hanger portion 24 can be supplied with hot air in the same way as the hot air nozzles 6.

With the apparatus according to the invention represented in FIG. 1, items of clothing 2 can be first washed, dried, and, finally, smoothed, without it being necessary for the items of clothing 2 to be taken out of the apparatus. Firstly, the items of clothing 2 are suspended on the suspending devices 4. For such a purpose, the suspending devices 4 may be removed from the housing 1, the items of clothing 2 hung on the suspending devices 4 and the latter subsequently suspended again in the housing 1 on the connecting struts between the transporting belts 3. After the housing 1 has been closed, the washing operation is initiated. For such a purpose, the transporting belts 3 are set in motion to move the items of clothing 2 clockwise through the housing, and the generator 5 is activated by a non-illustrated controller such that it passes fresh water from the fresh water feed to the liquid nozzles 8. In this case, the water is passed through a non-illustrated flushing-in device, into which detergent in either powdered and/or liquid form can be filled. The detergent is, in this case, flushed into the housing 1. As soon as a set level of liquid is reached in the housing 1 or a specific predetermined amount of liquid has been fed in, the generator 5 stops the feed of fresh water and begins to remove water from the sump 18 and pass it to the liquid nozzles 8, the water being heated up to a set temperature. The water, now mixed with the detergent, is made to circulate as washing liquid and may, additionally, also be sprayed onto the items of clothing 2 from inside through the suspending devices 4. In such an operation, dirt is flushed out of the items of clothing 2.

Subsequently, in a rinsing phase, the washing liquid is pumped out into a wastewater connection by the outflow pump 12. Subsequently, the items of clothing 2 are rinsed, in order to remove the washing liquid from them. For this purpose, fresh water is pumped to the liquid nozzles 8 in a number of rinsing cycles and the water together with the rinsed-out washing liquid is pumped away by the outflow pump 12. The rinsing effect can be intensified if, at the end of each rinsing cycle, the liquid feed to the liquid nozzles 8 is interrupted and the compressed air nozzles 7 are supplied with compressed air. When the items of clothing 2 are moved between the compressed air nozzles 7, they are pressed together by the compressed air jets, whereby the rinsing liquid is squeezed out of them. As such, scarcely any residues of the washing liquid or contaminants remain after the rinsing cycle. As a result, a smaller number of rinsing cycles or less rinsing liquid is required. The air passed to the compressed air nozzles 7 may also be heated in the process, whereby the liquid drawn up from the items of clothing 2 flows out more easily and, consequently, the water removal by compressed air at the end of the rinsing cycles can be intensified.

The rinsing is followed by a drying and smoothing step. Firstly, the items of clothing 2 are dried to a defined moisture content. For such a purpose, heated air is passed to the hot air nozzles 6. At the same time, the housing rear wall 15 is cooled with fresh water from the fresh water connection. As such, the moisture extracted from the items of clothing 2 condenses on the rear wall 15 and runs into the sump 18, from which it can be pumped away together with the cooling water for the rear wall 15 by the outflow pump 12. In such a case, the air inside the housing 1 is made to circulate, for which purpose the generator 5 draws in the air inside the housing 1.

Furthermore, there is the possibility of removing moisture from the items of clothing 2 to the desired moisture content based upon the exhaust air principle, in that, air is constantly blown out from the interior of the housing 1 by a blower or fan 14. In this way, the moisture extracted from the items of clothing 2 is discharged, the generator 5 having to draw in air from the outside. However, this method requires the apparatus to be set up in an adequately ventilated room in order to carry away the discharged moisture. The two possibilities, either of condensing the moisture in the apparatus and pumping it away or of discharging it, allow the operator to decide between the two variants in accordance with the respective conditions. The condensing of the moisture in the apparatus has the advantage that the room in which it is set up does not have to be ventilated. As an advantageous result, there is no loss of energy for heating the room in which it is set up, for example, in winter. In summer, on the other hand, the exhaust air variant may be chosen, which does not require any fresh water for cooling the rear wall 15 and less energy for heating the dry air.

When the desired moisture content has been reached, the smoothing operation can be commenced. For such a purpose, the items of clothing 2 are subjected to hot compressed air with the aid of the compressed air nozzles 7, whereby they are fully dried. In the moist state, the fabric of the items of clothing 2 is still relaxed. As a result, it can be smoothed much better. The smoothing takes place by the force exerted by the compressed air jets from the compressed air nozzles 7 on the items of clothing. This force can be set to a desired effect by setting the pressure of the air passed to the compressed air nozzles 7. In particular, the force is set such that the items of clothing 2 do not flutter, but, instead, the portion of an item of clothing 2 respectively located between the compressed air nozzles 7 is stretched tight.

For example, the two compressed air nozzles 7 may exert differently distributed surface forces on the items of clothing. As a result, the forces acting on a specific part of an item of clothing 2 from both sides do not cancel one another out. The surface force profiles of the forces exerted by the two compressed air nozzles 7 are, advantageously, complementary to one another. As a result, for example, in the areas in which a high surface force is generated by the left-hand compressed air nozzle 7, a low surface force is generated by the right-hand compressed air nozzle 7, and vice-versa. In this respect, the forces are configured such that the items of clothing are held approximately midway between the two compressed air nozzles 7.

As such, stretching forces that stretch the individual fabric portions of the item of clothing 2, and, thereby, smooth them, can be exerted on an item of clothing 2 by compressed air. This operation is repeated every time a specific item of clothing 2 is passed between the two compressed air nozzles 7. During this operation, furthermore, heated hot air can be directed onto the items of clothing by the hot air nozzles 6. In this respect, it should be ensured that hot air is expelled only with little pressure, in order not to lead to fluttering or crumpling of the items of clothing 2. The items of clothing 2 are, further, dried during this smoothing operation, the extracted moisture, as described above, either condensing on the cooled rear wall 15 and being pumped away by the outflow pump 12 or collected in the appliance and returned to the next washing process, or blown out by the blower 14.

As soon as the items of clothing 2 are fully dried, they are moved further in the housing 1, though now only cold air is blown in through the hot air nozzles 6 and/or the compressed air nozzles 7. This achieves the effect that the smoothed items of clothing 2 are cooled down and are less sensitive to creasing because the fabric crumples more easily in the hot state. Furthermore, an operator is prevented from burning on hot parts inside the housing 1. After the items of clothing 2 and the apparatus have cooled down, the items of clothing 2 can be removed.

To smooth the items of clothing 2 without a prior washing cycle, the items of clothing may be moistened with a little fresh water from the liquid nozzles 8. As a result, the fabric of the items of clothing 2 is made to relax. After that, the items of clothing 2 can be smoothed and dried as described above.

Figure 3:
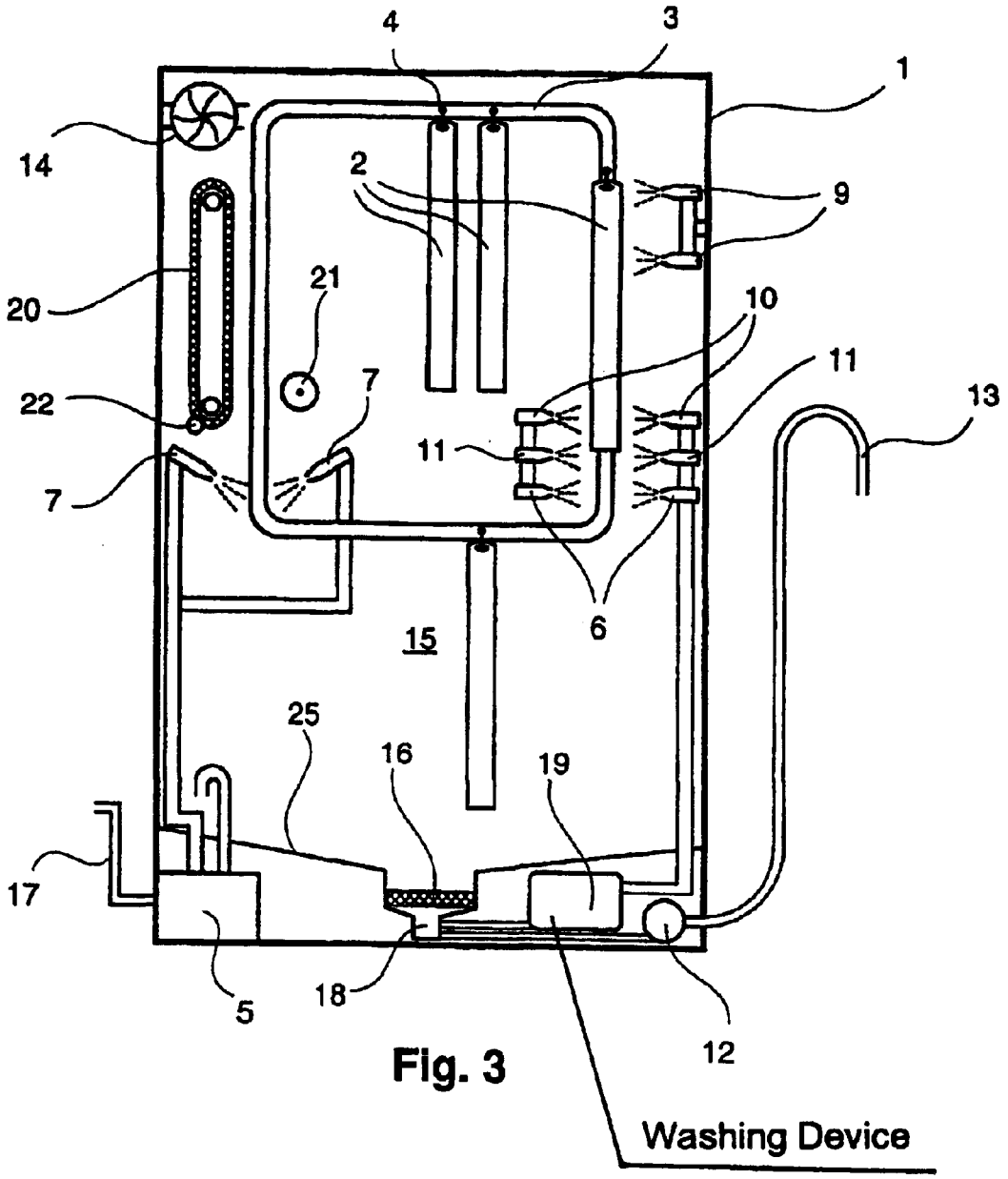
FIG. 3 is a cross-sectional view of a second embodiment of an apparatus according to the invention for smoothing items of clothing.

Represented in FIG. 3 is an apparatus for washing and smoothing items of clothing 2 according to a second embodiment. In this embodiment, a device for the preliminary mechanical removal of moisture from the items of clothing 2 is additionally provided, by which liquid can be removed mechanically from the items of clothing at the beginning of the drying phase. As a result, less energy has to be expended for the drying. Furthermore, separate nozzles are provided for the various treatment liquids or gases.

In the same way as in the first embodiment, the apparatus has a housing 1, two transporting belts 3, suspending devices 4 for items of clothing 2, and an outflow pump 12 with an outlet 13. Also disposed in the housing 1 there is, likewise, a false floor 25, in which a sump 18 with a lint filter 16 is formed and which divides off a dry space at the bottom in the housing 1. However, in this embodiment, the generator 5 is set up only for generating compressed air, which is heated if need be and is passed to the compressed air nozzles 7. Also disposed in the dry space underneath the false floor 25 is a washing device 19, which is connected to the sump 18 and a non-illustrated fresh water feed and has a liquid pump and a heating device. The washing device 19 is set up such that it can remove liquid either from the fresh water feed or from the sump 18 and pass it on to various nozzles, it being possible for the liquid to be heated and, in particular, for liquid removed from the fresh water feed to be vaporized. Also provided in the washing device is a flushing-in device, with which detergent can be flushed into the housing 1.

Connected to the washing device 19 are wetting nozzles 9, washing nozzles 10, rinsing nozzles 11, and hot steam nozzles 6, which are disposed on the right-hand side of the housing 1. The wetting nozzles 9 are supplied with fresh water and serve for wetting dry items of clothing 2. The washing nozzles 10 are supplied with washing liquid, in particular, heated washing liquid, which is made to circulate, in particular, through the sump 18, and serve for washing the items of clothing 2. The rinsing nozzles 11 are supplied with cold fresh water and serve for rinsing out the washing liquid from the items of clothing 2. The hot steam nozzles 6 are supplied with heated water vapor, which is obtained from fresh water, and serve for steaming the items of clothing 2.

As in the case of the previous exemplary embodiment, disposed at the bottom of the left-hand inside wall of the housing 1 are two mutually opposite compressed air nozzles 7, which are connected to the generator 5. Disposed over the compressed air nozzles 7 is a moisture-absorbing nonwoven 20, which is mounted near the inside wall by two deflecting rollers such that it can be driven like a conveyor belt and, thereby, moves parallel to the path of movement of the items of clothing 2.

The moisture-absorbing nonwoven 20 is of a highly absorbent material and is driven at the same speed as the items of clothing 2. As a result, the portion respectively lying on the inside is moved upward together with the items of clothing 2. Disposed on the side of the transporting belt 3 opposite from the moisture-absorbing nonwoven 20 is a pressing roller 21, which is provided with a compliant coating. The distance between the pressing roller 21 and the moisture-absorbing nonwoven 20 can be changed. As a result, it is possible either to press the items of clothing 2 between the pressing roller 21 and the moisture-absorbing nonwoven 20 as they are moved through or to move the items of clothing 2 through without them being touched by the moisture-absorbing nonwoven 20. Provided at the lower deflecting roller of the moisture-absorbing nonwoven 20 is a squeezing roller 22, which is disposed at such a small distance from the lower deflecting roller that the moisture-absorbing nonwoven 20 is strongly pressed together between the lower deflecting roller and the squeezing roller 22, and, in this way, liquid contained in the moisture-absorbing nonwoven 20 is squeezed out.

For washing and smoothing the items of clothing 2, they are suspended in the housing 1 as described above by the suspending devices 4. In the second exemplary embodiment, too, the transporting belts are moved clockwise. Firstly, the items of clothing 2 are wetted with fresh water by the wetting nozzles 9. Subsequently, the items of clothing 2 are moved further to the washing nozzles 10, by which they are sprayed with washing liquid that is generated in the washing device 19 by flushing in detergent in fresh water. The washing liquid is pumped out of the sump 18 by the washing device 19 in circulation, heated and sprayed onto the items of clothing 2 so that contaminants are flushed out.

After the washing, the washing liquid is pumped away by the outflow pump 12 and the items of clothing 2 are rinsed so as to rinse out the washing liquid and residues of the contaminants. For such a purpose, fresh water is sprayed onto the items of clothing 2 by the rinsing nozzles 11 and pumped away in a number of rinsing cycles. The rinsing operation may take the same form as in the previous exemplary embodiment.

After the rinsing, moisture is further removed mechanically from the items of clothing 2 by the moisture-absorbing nonwoven 20. For such a purpose, the distance between the moisture-absorbing nonwoven 20 and the pressing roller 21 is reduced to such an extent that the item of clothing 2 moved through is pressed by the pressing roller 21 against the moisture-absorbing nonwoven 20. As this happens, the highly absorbent material of the moisture-absorbing nonwoven 20 extracts further moisture from the item of clothing 2. The moisture taken up by the moisture-absorbing nonwoven 20 is squeezed out again between the lower deflecting roller and the squeezing roller 22. As a result, the part of the moisture-absorbing nonwoven 20 that is actually in contact with the item of clothing 2 always contains as little moisture as possible to be able to extract as much moisture as possible from the item of clothing 2. This purely mechanical type of moisture removal requires no heat, for the generation of which considerable energy is required disadvantageously. As a result, with the aid of the moisture-absorbing nonwoven 20, the moisture content of the items of clothing 2 can be reduced with particularly little expenditure of energy.

In addition, with this type of moisture removal based upon the absorbent effect of the moisture-absorbing nonwoven 20, considerable moisture can be extracted from the items of clothing 2 just with a small pressing pressure. As a result, the items of clothing 2 are not crumpled and, nevertheless, the moisture is largely removed from them. The pressing pressure may be adjustable by changing the distance between the pressing roller 21 and the moisture-absorbing nonwoven 20, in particular, in dependence on the fabric and the thickness of the items of clothing 2.

After the preliminary removal of moisture by the moisture-absorbing nonwoven 20, the items of clothing 2 are further dried with hot air. This takes place in the same way as in the previous exemplary embodiment. The smoothing operation is commenced as soon as the items of clothing have the suitable moisture content. If moisture has already been adequately removed from the items of clothing by the moisture-absorbing nonwoven 20, the items of clothing 2 can be smoothed immediately after the preliminary mechanical removal of moisture. If the preliminary mechanical removal of moisture was not adequate, the items of clothing 2 are dried with warm or hot air from the compressed air nozzles 7 to the suitable moisture content. The smoothing is performed by subjecting the items of clothing to hot steam from the hot steam nozzles 6, whereby the fabric of the items of clothing 2 is heated and made to relax. Subsequently, the items of clothing 2 are passed through between the two compressed air nozzles 7. The compressed air emerging from the compressed air nozzles 7 has the effect that the fabric of the items of clothing 2 is stretched and smoothed, the smoothing operation and the compressed air jets used corresponding to the previous exemplary embodiment.

The hot steam nozzles 6 make it possible in the case of the second embodiment to smooth the items of clothing 2 without prior soaking. For such a purpose, for example, already washed and dried items of clothing 2 can be steamed in the apparatus and, then, smoothed and dried as described above.

After a specific time, the hot steam discharge of the hot steam nozzles 6 is stopped. The items of clothing are, then, just subjected to hot compressed air from the compressed air nozzles 7 to dry them fully during the smoothing. As soon as the desired moisture content is reached, the items of clothing are just subjected to cold air to cool them down as in the previous exemplary embodiment. After that, the items of clothing 2 can be removed from the housing 1.

We claim:

1. A method for smoothing items of clothing, which comprises:

providing an item of clothing;

providing at least one gas jet for supplying a pressurized stream of a gas;

subjecting the clothing item at least in one portion to the at least one gas jet in a direction not parallel to the one portion;

applying a force on the clothing item with the pressurized stream of gas to smooth the clothing item; and supporting the clothing item from a side of the clothing item opposite the gas jet.

2. The method according to claim 1, which further comprises supporting the clothing item with a supporting surface.

3. The method according to claim 2, which further comprises supporting the clothing item with an air-permeable supporting surface.

4. The method according to claim 2, which further comprises disposing the clothing item between two air-permeable surfaces.

5. The method according to claim 1, which further comprises supporting the clothing item with the gas stream.

6. The method according to claim 5, which further comprises acting on both sides of the item of clothing with the at least one gas jet to exert a total force on the clothing item that is equal in an amount in opposing directions.

7. The method according to claim 5, which further comprises exerting a force with the at least one gas jet on both sides of the item of clothing such that a total force on the clothing item is equal in opposing directions.

8. The method according to claim 5, which further comprises subjecting portions of the clothing item to the gas stream with a higher force from one side of the clothing item than from another side of the clothing item.

9. A method for smoothing items of clothing, which comprises:

providing an item of clothing;

providing at least one gas jet for supplying a stream of a gas;

subjecting the clothing item at least in one portion to the at least one gas jet in a direction not parallel to the one portion;

supporting the clothing item from a side of the clothing item opposite the gas jet;

supporting the clothing item with the gas stream; and subjecting portions of the clothing item to the gas stream with different forces from different sides of the clothing item.

10. The method according to claim 1, which further comprises moving the at least one gas jet and the clothing item with respect to one another.

11. The method according to claim 1, which further comprises supplying a heated as stream with the at least one gas jet.

12. The method according to claim 1, which further comprises supplying water vapor with the gas stream from the at least one gas jet.

13. A method for smoothing items of clothing, which comprises:

providing an item of clothing;

providing at least one gas jet for supplying a stream of a gas;

subjecting the clothing item at least in one portion to the at least one gas jet in a direction not parallel to the one portion; and at the end of a smoothing operation of the clothing item, initially supplying substantially dry and heated air to the clothing item with the at least one gas jet and subsequently supplying substantially dry and non-heated air to the clothing item with the at least one gas jet.

14. The method according to claim 1, which further comprises initially moistening the clothing item.

15. The method according to claim 1, which further comprises moistening the clothing item before subjecting the clothing item to the at least one gas jet.

16. A method for smoothing items of clothing, which comprises:

providing an item of clothing;

providing at least one gas jet for supplying a stream of a gas;

subjecting the clothing item at least in one portion to the at least one gas jet in a direction not parallel to the one portion; and changing at least one of an outflow speed, a volume flow, and a directional distribution of the at least one gas jet when subjecting the clothing item to the gas stream of the at least one gas jet.

17. An apparatus for smoothing items of clothing, comprising:

a treatment housing defining a treatment space therein;

devices disposed in said housing for placing an item of clothing inside said treatment space;

a blower for generating a gas flow; and nozzles communicating with said blower for generating a pressurized gas stream in said housing, said nozzles being disposed in said housing and being aligned to direct said gas stream generated by said gas flow from said blower at the clothing item and said gas stream applying a force on the clothing item to smooth the clothing item.

18. The apparatus according to claim 17, further comprising a moistening device communicating with at least one of said nozzles for moistening said gas stream.

19. The apparatus according to claim 17, wherein said nozzles are aligned to direct said gas stream at an angle to the clothing item.

20. The apparatus according to claim 17, wherein said nozzles are aligned to direct said gas stream to at least a portion of the clothing item in a direction not parallel to the portion of the clothing item.

21. A method for smoothing items of clothing, which comprises the acts of:

providing a clothing item having a first side and a second side opposite the first side;

providing a gas jet for supplying a pressurized gas stream;

subjecting the clothing item to the gas jet;

applying a first force on the first side of the clothing item with the pressurized gas stream to smooth the clothing item; and supporting the clothing item with a second force on the second side of the clothing item that opposes the first force.

22. The method according to claim 21, wherein the act of supporting the clothing item with the second force is performed with a solid member.

23. The method according to claim 21, wherein the act of supporting the clothing item with the second force is performed with an air-permeable member.

24. The method according to claim 21, further comprising providing a second gas jet for supplying a second pressurized gas stream and the act of supporting the clothing item with the second force is performed with the second pressurized gas stream.

25. The method according to claim 24, wherein the first force is different than the second force.

* * * * *